US008184054B2

(12) United States Patent
Tsujimura

(10) Patent No.: US 8,184,054 B2
(45) Date of Patent: May 22, 2012

(54) PORTABLE TERMINAL AND BUILT-IN ANTENNA

(75) Inventor: Akihiro Tsujimura, Kokubunji (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 425 days.

(21) Appl. No.: 12/512,240

(22) Filed: Jul. 30, 2009

(65) Prior Publication Data

US 2010/0149047 A1 Jun. 17, 2010

(30) Foreign Application Priority Data

Dec. 12, 2008 (JP) ..... 2008-317006

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS 6,437,745 B1 * 8/2002 Vaisanen et al. ..... 343/702
7,570,218 B2 8/2009 Tsujimura et al.
8,098,204 B2 1/2012 Tsujimura et al.
2008/0203174 A1 * 8/2008 Watanabe ..... 235/492
2010/0081489 A1 * 4/2010 Ohba et al. ..... 455/575.3
2011/0156962 A1 * 6/2011 Jeong et al. ..... 343/700 MS

FOREIGN PATENT DOCUMENTS

JP 5-44047 A 2/1993
JP 2005-295578 A 10/2005
JP 2007-288360 A 11/2007

OTHER PUBLICATIONS

Japanese Office Action dated Mar. 6, 2012 (and English translation thereof) in counterpart Japanese Application No. 2008-317006.

* cited by examiner

*Primary Examiner* — Tan Ho
(74) *Attorney, Agent, or Firm* — Holtz, Holtz, Goodman & Chick, PC

(57) ABSTRACT

A portable terminal includes a non-conductive resin chassis that is formed by molding a molding material and internally provided with a printed circuit board on which a wireless circuit is formed, and an antenna pattern that is disposed on a wall surface of the chassis and in a region excluding a eject pin track formed when the chassis electrically connected with the printed circuit board is formed, wherein the antenna pattern is constituted by sequentially laminating a copper layer, a nickel layer and a gold layer by electroless plating, and the nickel layer is rendered amorphous.

18 Claims, 6 Drawing Sheets

PORTABLE TERMINAL AND BUILT-IN ANTENNA

CROSS-REFERENCE TO RELATED APPLICATIONS

This application is based upon and claims the benefit of priority from prior Japanese Patent Application No. 2008-317006, filed Dec. 12, 2008, the entire contents of which are incorporated herein by reference.

BACKGROUND OF THE INVENTION

1. Field of the Invention

The present invention relates to a portable terminal that is rotatably openable and used in mobile communication such as of so-called clamshell, slide or swivel portable telephone or a portable information instrument, and a built-in antenna.

2. Description of the Related Art

A portable terminal has been diversified in function. On the other hand, users demand a smaller and lighter portable terminal from the viewpoint of portability. As a technology for miniaturizing and reducing the thickness of a terminal to satisfy such a demand, a miniaturization technology of an antenna a physical magnitude of which determines performance upon communicating externally is important.

As a technology for miniaturizing an antenna, a technology in which, for example, a conductor pattern is partially disposed on a chassis that incorporates a printed circuit board on which a wireless circuit is mounted, and the conductor pattern and the wireless circuit are pressure-bonded with a plate spring made of a plate or a spring connector to mutually connect electrically to function as an antenna has been proposed (for example, Jpn. Pat. Appln. KOKAI Publication No. 2005-295578).

By the way, the chassis is generally made of plastic, and a method where a metal that becomes a conductor pattern is plated by electroless plating on a chassis made of such a material has been known (for example, Jpn. Pat. Appln. KOKAI Publication No. 5-44047). In the electroless plating method, a material to be plated is treated with a solution containing trivalent iron ions and divalent metallic ions capable of forming a ferrite magnetic body therewith, followed by neutralizing to precipitate ferrite on a surface thereof, further followed by treating in an electroless plating bath.

However, in an antenna formed by an electroless plating method according to Patent Document 2, when the antenna is used under high-temperature and high-humidity conditions for a long time, there is a problem in that an impurity such as water penetrates through pinholes into the conductor pattern to tend to cause corrosion of the plating.

BRIEF SUMMARY OF THE INVENTION

The present invention intends to provide a portable terminal and a built-in antenna, in which a nickel layer that is one constituent of an antenna pattern is rendered amorphous, whereby pinhole formation is inhibited, and further corrosion is avoided.

DETAILED DESCRIPTION OF THE INVENTION

Figure 1:
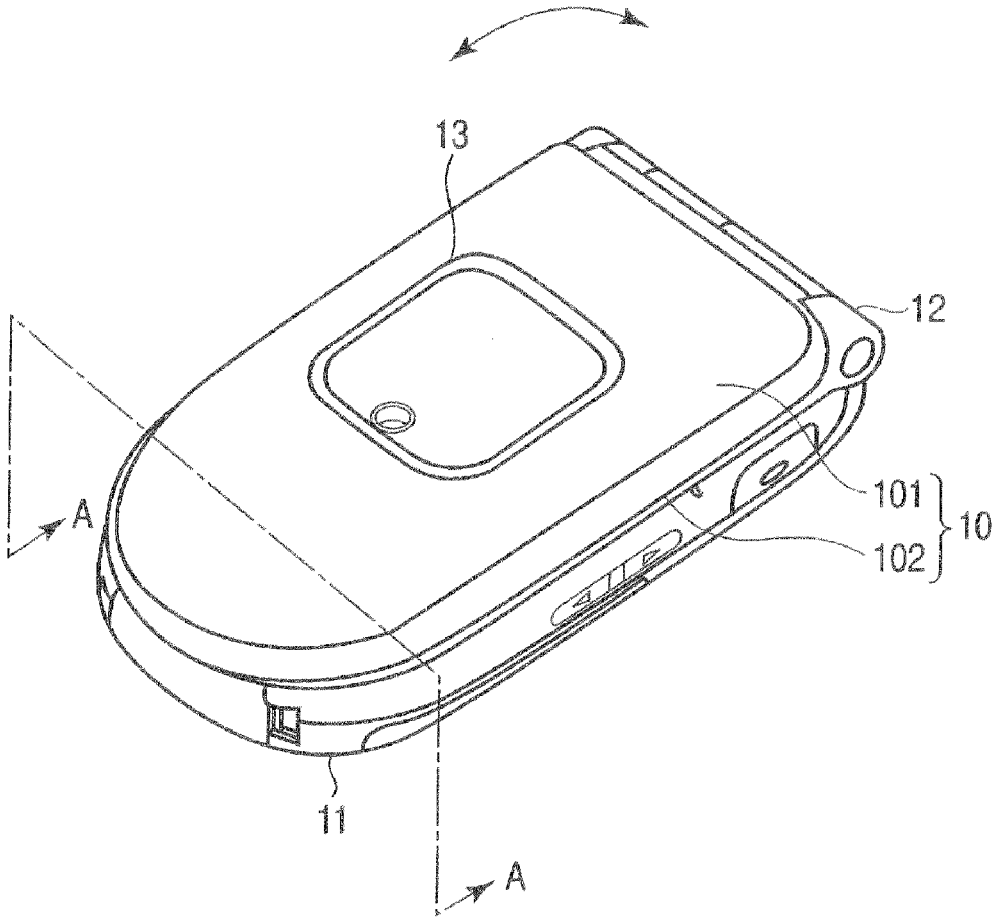
FIG. 1 is a perspective view for describing a portable terminal and a built-in antenna according to a first embodiment of the invention.

A portable terminal according to the invention includes a non-conductive resin chassis that is formed by molding a molding material and internally provided with a printed circuit board on which a wireless circuit is formed, and an antenna pattern that is disposed on a wall surface of the chassis and in a region excluding an eject pin track formed when the chassis electrically connected with the printed circuit board is formed, wherein the antenna pattern is constituted by sequentially laminating a copper layer, a nickel layer and a gold layer by electroless plating, and the nickel layer is rendered amorphous.

A built-in antenna according to the invention includes a molded body that forms a nonconductive resin chassis that is formed by molding a molding material and internally provided with a printed circuit board on which a wireless circuit is formed, and an antenna pattern that is disposed on a wall surface of the molded body and in a region excluding an eject pin track formed when the chassis electrically connected with the printed circuit board is formed, wherein the antenna pattern is constituted by sequentially laminating a copper layer, a nickel layer and a gold layer by electroless plating, and the nickel layer is rendered amorphous.

According to the present invention, a portable terminal capable of inhibiting pinhole formation by rendering a nickel layer that is one constituent of an antenna pattern amorphous and thereby avoiding corrosion, and a built-in antenna are provided.

In what follows, a portable terminal and a built-in antenna of the invention will be described in more detail.

(1) A terminal according to an embodiment of the invention, as mentioned above, includes a nonconductive resin chassis and an antenna pattern, wherein the antenna pattern is configured by sequentially laminating a copper layer, a nickel layer and a gold layer by use of electroless plating, and the nickel layer is rendered amorphous.

(2) In (1), the Vickers hardness of a surface of the antenna pattern is preferably in the range of 500 to 550 HV. Herein, when the Vickers hardness is outside the above numerical range, the amorphous nickel layer may not be maintained.

(3) The antenna pattern is configured of two open ends and an intermediate portion between the open ends, wherein it is preferred that the line width of the thinnest portion of the antenna pattern is 0.3 mm or more, and the average thickness of plating of the two open ends and intermediate portion is 10 μm or more for the copper layer, 6 μm or more for the nickel layer and 0.03 μm or more for the gold layer. Herein, when the line width is set in the above numerical range, the antenna characteristics and plating precipitation become excellent. When the line width is less than 0.3 mm, the plating does not precipitate. When the thickness of the copper layer is set in the above numerical range, the electrical resistance becomes smaller, producing excellent antenna characteristics. The thickness of plating can be measured with X-ray fluorescence. Furthermore, when the nickel layer is set in the above numerical range, the corrosion resistance becomes excellent, and when the gold layer is set in the above numerical range, the contact resistance becomes excellent.

(4) The antenna pattern is configured of two open ends and an intermediate portion between the open ends, and the product WT of the line width W of the thinnest portion of the antenna pattern and the thickness T of an average copper layer of two open ends and an intermediate portion is preferably $3\times10^{-9}$ $m^2$ or more. Thereby, an antenna pattern may function well.

(5) The antenna pattern is configured of two open ends and an intermediate portion between the open ends and, when the line width of the thinnest portion of the antenna pattern is represented by W, the thickness of an average copper layer of two open ends and an intermediate portion is represented by T, the resistance of the average copper layer is represented by R, the line length of the antenna pattern is represented by L and the conductivity of the copper layer is represented by σ, $\sigma=L/R\cdot W\cdot T$ is preferably satisfied.

(6) The internal stress of the antenna pattern is preferably within ±10 MPa. Thereby, antenna pattern corrosion is inhibited.

(7) The rate of elongation of the antenna pattern is preferably 1 to 5%. Thereby, antenna pattern corrosion is inhibited.

(8) After a salt water resistance test for 96 hours, carbonate or sulfate is preferably 3 times or less that before the test in an ion spectrum by time-of-flight secondary ion mass spectrometry. Thereby, antenna pattern corrosion is inhibited.

(9) The dissolution temperature of the nonconductive resin is preferably 65° C. or more. Thereby, outer cover dissolution is inhibited, though heal is generated when a microcrystalline Ni layer is rendered amorphous.

(10) A built-in antenna of the invention includes, as mentioned above, a molded body that forms a nonconductive resin chassis and an antenna pattern, wherein the antenna pattern is constituted by sequentially laminating a copper layer, a nickel layer and a gold layer by means of electroless plating, and the nickel layer is rendered amorphous.

In what follows, embodiments of the invention will be described. However, the embodiments are not restricted to what is mentioned below.

First Embodiment

FIG. 1 will be referred to. FIG. 1 shows a configuration of a clamshell portable telephone according to a first embodiment of the invention. A second chassis 11 is linked to a first chassis 10 to be rotatably openable in an arrow direction via a hinge mechanism 12. That is, the first chassis 10 is a molded body and is constituted of, for example, an outer cover 101 on which a sub-display 13 is disposed and an inner cover 102 disposed on a main display (not shown). The outer cover 101 and the inner cover 102 are made of a non-conductive resin such as polycarbonate (PC), ABS or PC/ABS. The dissolution temperature of the nonconductive resin is 65° C. or more. A not-shown telephone body that contains, for example, a controller and a power supply is incorporated in the second chassis 11. A not-shown operation unit is disposed on an inner surface side of the second chassis 11.

Figure 2:
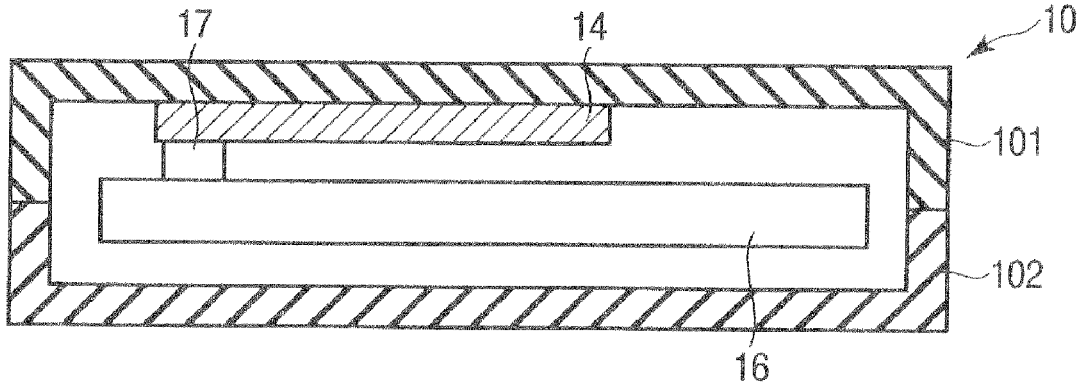
FIG. 2 is a sectional view along A-A in FIG. 1.

Herein, the outer cover 101 and inner cover 102 of the first chassis 10 and the second chassis 11 are formed into a desired chassis shape by injection molding a molding material of a nonconductive material such as a dielectric material or a nonmetallic material with, for example, an existing injection molding machine (see FIG. 2). Among these, on the outer cover 101 of the first chassis 10, for example, a built-in antenna according to the first embodiment of the invention is formed.

Figure 3:
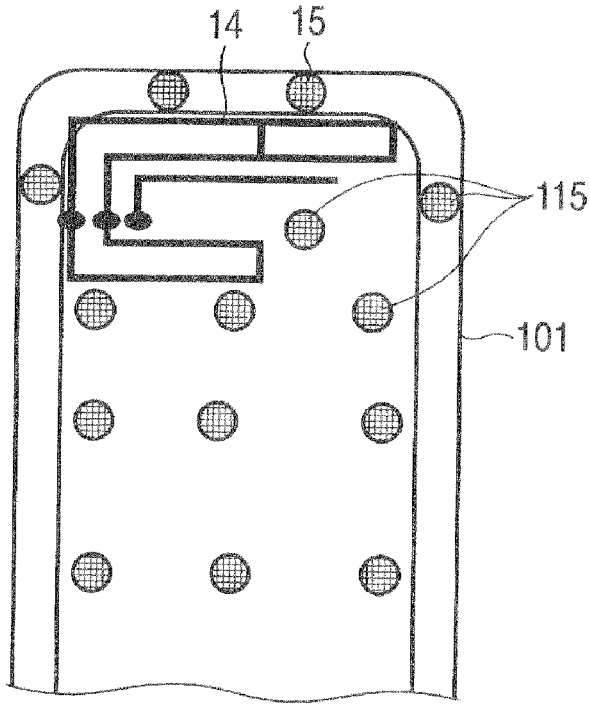
FIG. 3 is a plan view for describing the positional relationship between an example of an antenna pattern in FIG. 2 and an eject pin track.

In the outer cover 101, as shown in FIG. 3, a position of a cutting extrusion pin during injection molding is injection molded on a site excluding a wiring region of an antenna pattern 14 formed by electroless plating. A straight or curved antenna pattern 14 having desired antenna characteristics is formed by electroless plating on an inner wall of the outer cover 101 and in a region except for a site where an eject pin track 15 remained during injection molding is present. The antenna pattern 14 is electrically connected through a connecting portion 17 to a wireless circuit (not shown) disposed on a printed circuit board 16.

Figure 4:
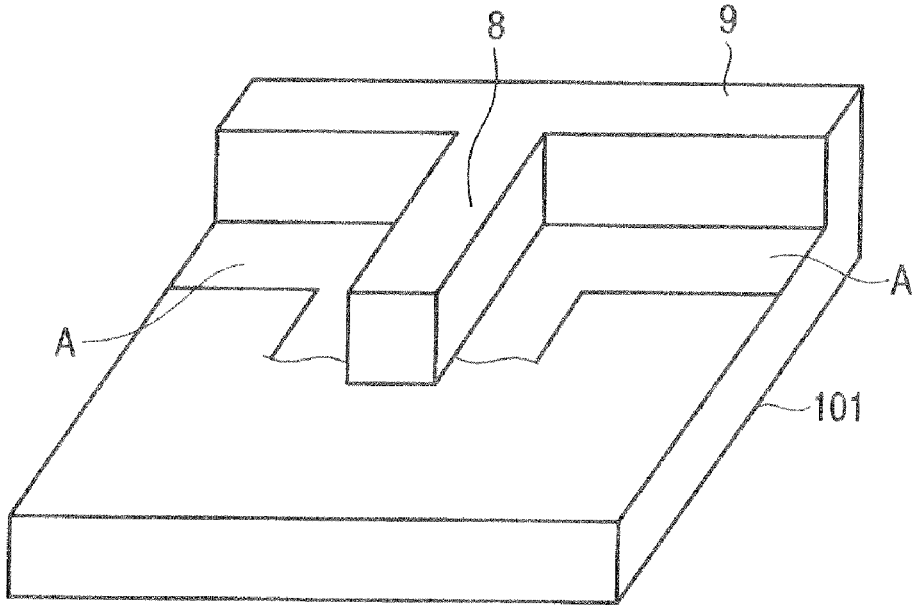
FIG. 4 is a perspective view showing an example of arrangement of an erected wall and a reinforcement rib of an outer cover of FIG. 2.
Figure 5:
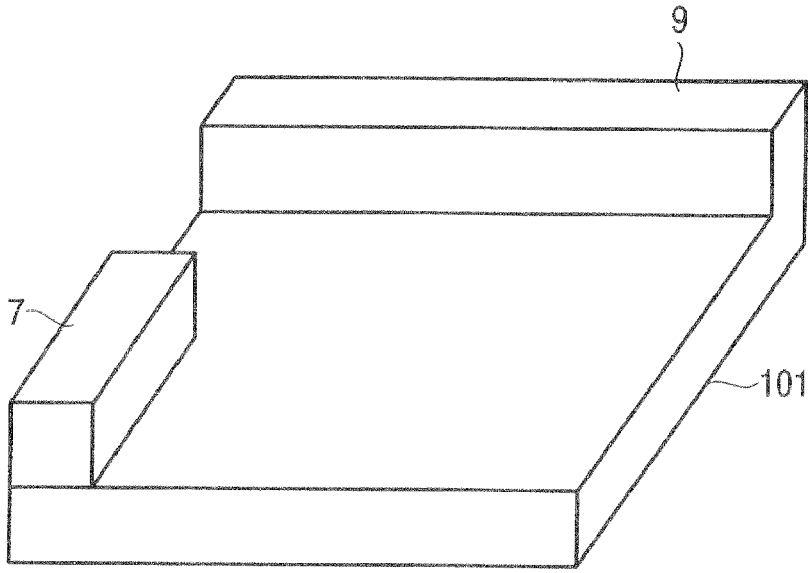
FIG. 5 is a perspective view showing an example of arrangement of an integrating engagement claw of the outer cover in FIG. 2.

The extrusion pin of the outer cover 101 is set on a site capable of imparting uniform extrusion force during injection molding. Furthermore, the extrusion pin is set, for example as shown in FIG. 4, on an erected wall 9 disposed in the periphery thereof, on a reinforcement rib 8, in a range A that is in the proximity of the sidewalls and forms a so-called corner portion, on an integrating engagement 7 as shown in FIG. 5 and a range adjacent the sidewall, and in a region excluding the antenna pattern 14.

Figure 7:
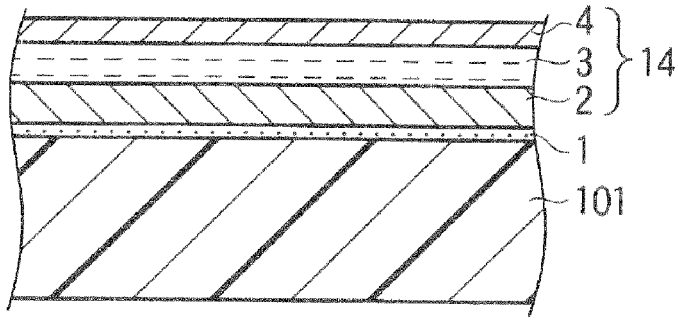
FIG. 7 is a partial sectional view of an antenna pattern in FIG. 1.
Figure 8A:
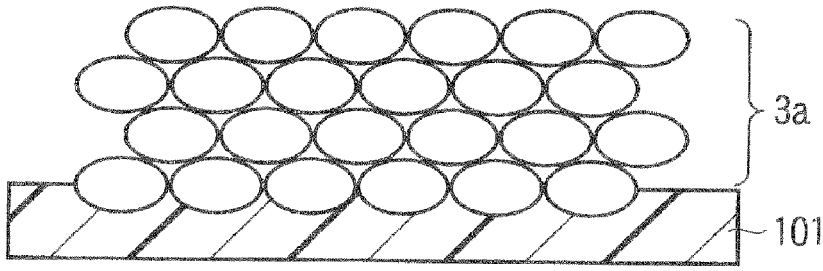
FIG. 8A is a diagram for describing a state where a microcrystalline Ni layer is formed on an outer cover.
Figure 8B:
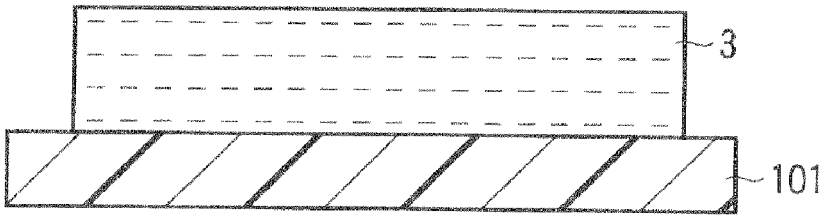
FIG. 8B is a diagram for describing how an Ni layer of the antenna pattern in FIG. 1 is rendered amorphous.

The antenna pattern 14 is constituted, as shown in FIG. 7, by sequentially laminating by electroless plating a copper layer 2, an amorphous nickel (Ni) layer 3 and a gold layer 4 via an adhesive layer 1 on the nonconductive resin outer cover 101. The amorphous Ni layer 3 is formed, as shown in FIG. 8A, by forming a microcrystalline Ni layer 3*a* followed by rendering amorphous (see FIG. 8B).

Figure 9A:
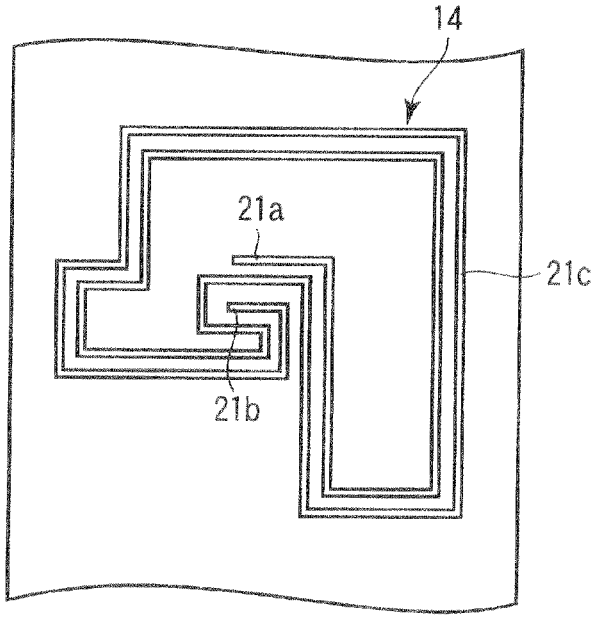
FIG. 9A is a plan view of the antenna pattern in FIG. 1.
Figure 9B:
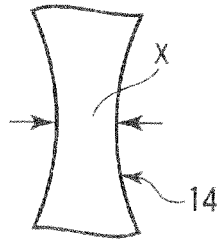
FIG. 9B is a plan view of a thin line portion of the antenna pattern in FIG. 1.
Figure 9C:
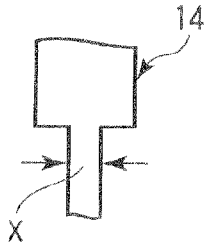
FIG. 9C is a plan view of another thin line portion of the antenna pattern in FIG. 1.

The antenna pattern 14 is made of, as shown specifically in FIGS. 9A to 9C, two open ends 21*a* and 21*b*, and an intermediate portion 21*c* between the open ends. The line width of the thinnest portion X of the antenna pattern 14 is 0.3 mm, or more, and the average plating thickness of the two open ends and intermediate portion 21*c* is 10 μm or more for the copper layer, 6 μm or more for the nickel layer and 0.03 μm or more for the gold layer. The antenna pattern 14 is formed conveniently in a rectangular form at a corner portion in FIG. 9A but it is actually formed in a curved line. Furthermore, a thin line portion X of the antenna pattern 14 shows a position such as FIG. 9B or 9C.

The product WT of the line width W of the thinnest portion of the antenna pattern 14 and the thickness T of an average copper layer of two open ends and an intermediate portion 21*c* is $3\times10^{-9}$ $m^2$ or more. The internal stress of the antenna pattern 14 is within ±10 MPa and the rate of elongation thereof is 1 to 5%.

According to the first embodiment, following advantages are obtained.

1) When the plating film is rendered amorphous, pinhole (small pore) formation is easily inhibited. Corrosion is considered to be caused by intrusion of water or an impurity through such a pinhole. Furthermore, a pinhole is in many cases started from a grain boundary. In the embodiment, an amorphous Ni layer 3 is disposed as a constituent of the antenna pattern 14, whereby grain boundary occurrence is inhibited.

2) The Vickers hardness of a surface of the antenna pattern 14 is set in the range of 500 to 550 HV, whereby antenna pattern 14 corrosion is inhibited. In Table 1 below, hardness, resistance and whether corrosion is generated or not are compared among electroless Ni (heated), electroless Ni (standard), Ni of the invention and electrolytic Ni. From Table 1, it is obvious that the case of the invention is freer from corrosion and more excellent than the other examples. In the case of the electrolytic Ni, there is no problem in the point of strength but there is a problem obviously in the point of corrosion.

TABLE 1

| | Electroless Ni (heated) | Electroless Ni (standard) | Present invention (amorphous) | Electrolytic Ni |
|---|---|---|---|---|
| Hardness (Hv) | 900 or more | 550~600 | 500~550 | 300 |
| Resistance (μΩ/cm) | 20 (small) | — | 60 (standard) | — |
| Whether there is corrosion or not | Corroded | Slightly corroded | No corrosion | Corroded |

3) The line width of the thinnest portion of the antenna pattern 14 is set to 0.3 mm or more, and the average plating thickness of the two open ends 21*a* and 21*b* and the intermediate portion 21*c* is set to 10 μm or more for the copper layer, to 6 μm or more for the nickel layer and to 0.03 μm or more for the gold layer. That is, when the line width is set in the above numerical range, the antenna characteristics and plating precipitation are rendered more excellent. Herein, when the line width is less than 0.3 mm, plating is not precipitated. Furthermore, when the thickness of the copper layer is set in the above numerical range, the antenna characteristics are rendered more excellent. The thickness of the plating may be measured by means of X-ray fluorescence. Furthermore, when the nickel layer is set in the above numerical range, the corrosion resistance is improved, and, when the gold layer is set in the above numerical range, the contact resistance is rendered more excellent. The resistance R of the antenna pattern 14 is obtained from the formula (1) shown below, in which the conductivity of the pattern 14 is σ, the line length of the pattern 14 is L, the line width is W, and the average plating thickness is T.

$$R=\sigma\cdot L/W\cdot T \quad (1)$$

4) The product WT of the line width W of the thinnest portion of the antenna pattern 14 and the thickness T of an average copper layer of the two open ends 21*a* and 21*b* and the intermediate portion 21*c* is set to $3\times10^{-9}$ $m^2$ or more. Thereby, the antenna pattern 14 functions more excellently.

Figure 10:
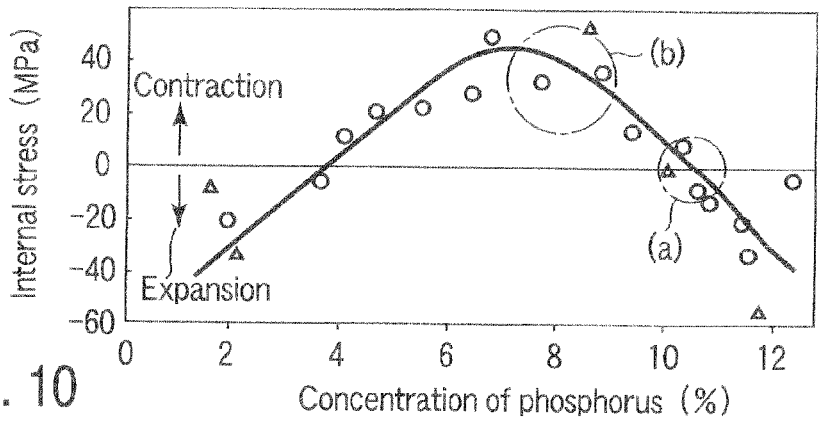
FIG. 10 is a characteristic diagram showing the relationship between the concentration of phosphorus in an Ni layer that is one constituent of the antenna pattern in FIG. 1 and the internal stress.

5) The internal stress of the antenna pattern 14 is set within ±10 MPa. Thereby, antenna pattern 14 corrosion is inhibited. FIG. 10 is a characteristic diagram showing the relationship between the concentration of phosphorus in an Ni layer of the antenna pattern and the internal stress of the antenna pattern. Furthermore, Table 2 shown below shows the internal stress and whether there is corrosion or not of each of Ni (heated), Ni (standard) and amorphous Ni of the invention. From FIG. 10 and Table 2, it is obvious that when the internal stress is within ±10 MPa, that is, the concentration of phosphorus in an Ni layer is 10 to 11%, corrosion is inhibited. In FIG. 10, as the internal stress goes into a region greater than zero, contraction tends to occur, and, as the internal stress goes into a region less than zero, expansion tends to occur. Furthermore, (a) in FIG. 10 is a region of a phosphorus concentration of the invention, and (b) is a region where an existing antenna pattern expands.

TABLE 2

| | Ni (heated) | Ni (heated) | Present invention (amorphous) |
|---|---|---|---|
| Internal stress (MPa) | −40~10 | 10~45 | 10~−10 |
| Whether there is corrosion or not | Corroded | Slightly corroded | No corrosion |

Figure 11:
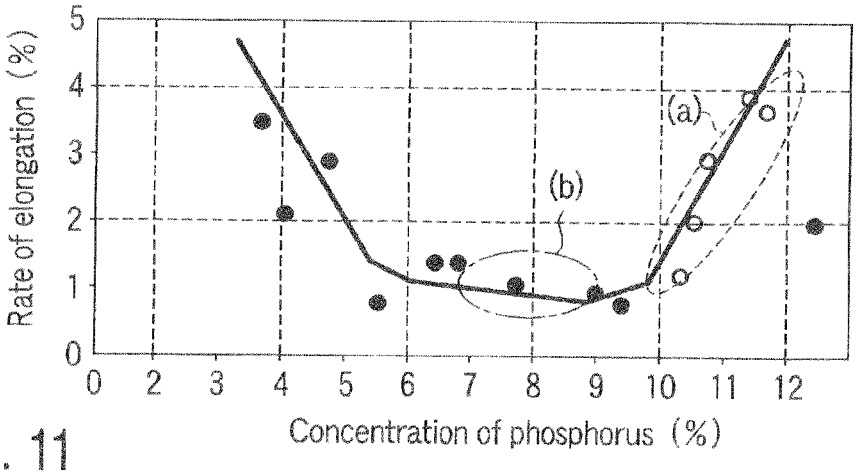
FIG. 11 is a characteristic diagram showing the relationship between the concentration of phosphorus in an Ni layer that is one constituent of the antenna pattern in FIG. 1 and the rate of elongation.

6) The rate of elongation of the antenna pattern is 1 to 5%. Thereby, antenna pattern 14 corrosion is inhibited. FIG. 11 is a characteristic diagram showing the relationship between a concentration of phosphorus in an Ni layer of the antenna pattern and the rate of elongation thereof. Table 3 shown below shows internal stress and whether there is corrosion or not of each of Ni (heated), Ni (standard) and amorphous Ni of the invention. From FIG. 11 and Table 3, it is obvious that when the rate of elongation is 1 to 5%, that is, when the concentration of phosphorus in an Ni layer is 10 to 12%, corrosion is inhibited. In FIG. 11, (a) is a region of the rate of elongation of the invention, and (b) is a region of the rate of elongation of conventional Ni (standard).

TABLE 3

| | Ni (heated) | Ni (heated) | Present invention (amorphous) |
|---|---|---|---|
| Rate of elongation (%) | 3.5~5 | 1 | 1~5 |
| Whether there is corrosion or not | Corroded | Slightly corroded | No corrosion |

7) The outer cover 101 is made of a nonconductive resin such as polycarbonate (PC), ABS or PC/ABS, which has the dissolution temperature of 65° C. or more. Thereby, although heat is generated when a microcrystalline Ni layer is rendered amorphous, dissolution of the outer cover 101 is inhibited.

Second Embodiment

Figure 6:
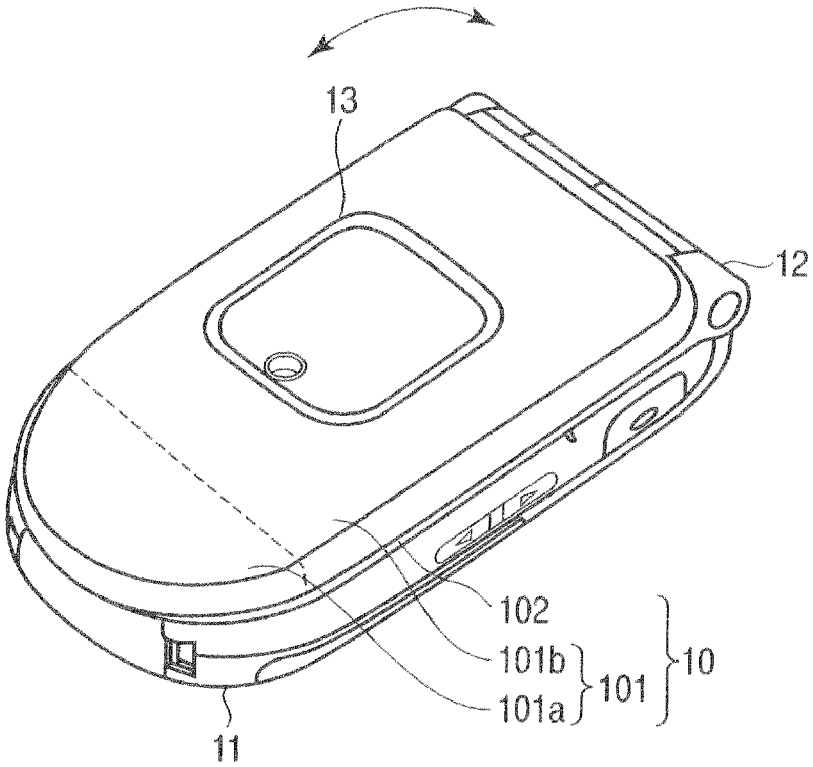
FIG. 6 is a perspective view for describing a portable terminal and a built-in antenna according to a second embodiment of the invention.

FIG. 6 will be referenced. FIG. 6 shows a configuration of a clamshell portable telephone according to a second embodiment of the invention. Members the same as those of FIG. 1 are provided with same reference numbers and descriptions thereof will be omitted. In the first embodiment, a case where the outer cover 101 of the first chassis 10 is formed as one molded body, and to the outer cover 101 the antenna pattern 14 is formed by means of the electroless plating to constitute a built-in antenna has been described.

In the second embodiment, for example, an outer cover 101 is formed into a cover structure having a desired shape by combining a first molded body 101*a* and a second molded body 101*b* as shown in FIG. 6, and on an inner wall surface of one of them, for example, the first molded body 101*a*, the antenna pattern 14 is formed by means of the electrolytic plating to constitute a built-in antenna.

In the embodiment, the product WT of the line width W of the thinnest portion of the antenna pattern and the thickness T of an average copper layer of two open ends and an intermediate portion is set to $3\times10^{-9}$ $m^2$ or more. However, without being limited thereto, with the conductivity of the antenna pattern represented by σ, the line length represented by L, and the resistance represented by R, $L/(R\cdot W\cdot T)\leqq 1$ may be satisfied.

Figure 12:
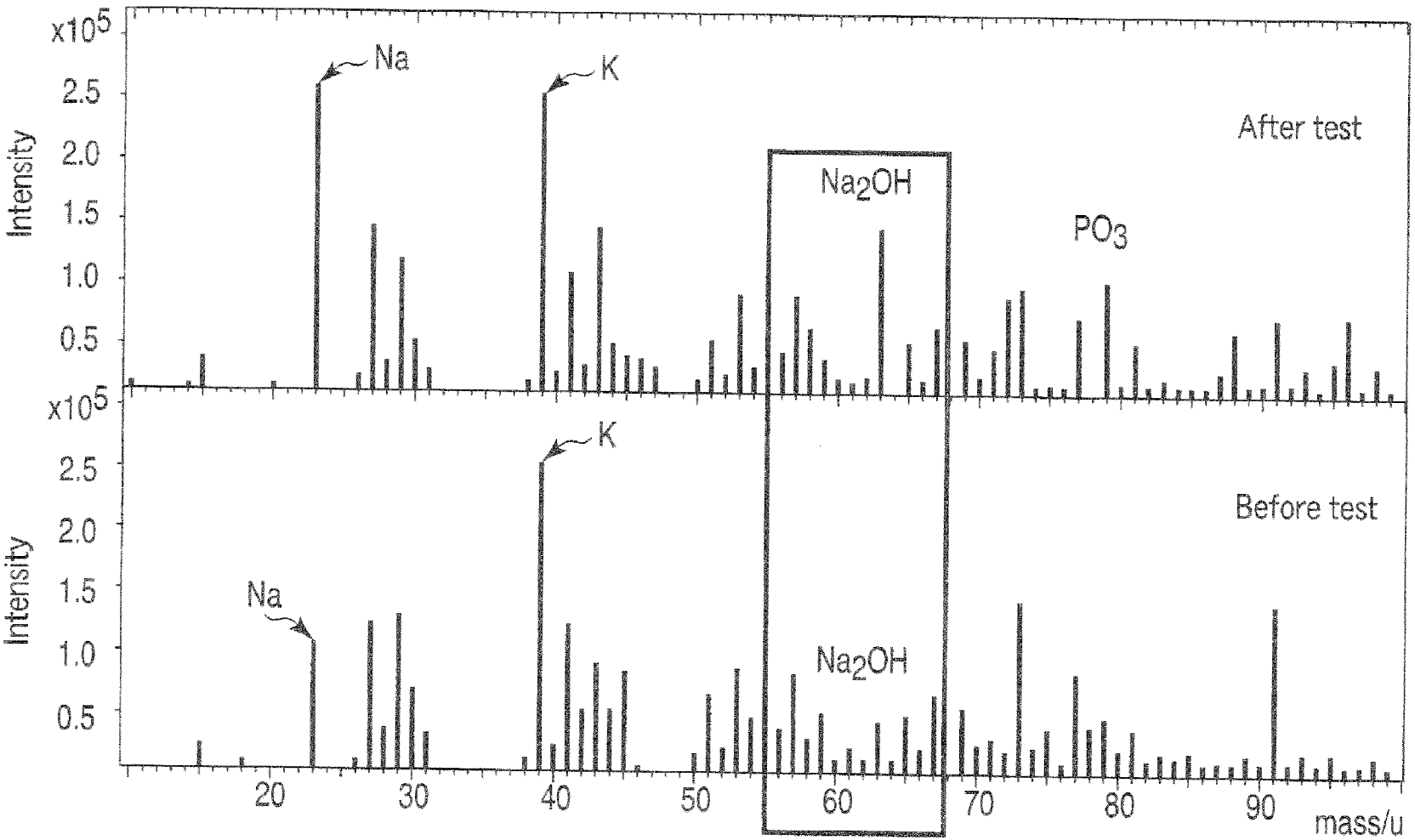
FIG. 12 is a spectrum characteristic diagram before and after test in which the antenna pattern of the invention is subjected to a salt water resistance treatment.

Furthermore, after a salt water resistance test for 96 hours, carbonate or sulfate may be made 3 times or less that before the test in an ion spectrum by time-of-flight secondary ion mass spectrometry (TOF-SIMS). FIG. 12 is a characteristic diagram showing results obtained by confirming corrosion with salt water (JIS Z2371) under the conditions of a concentration of salt water of 5%, a bath environment (temperature: 35° C., humidity: 98% Rh) and a spray time of 96 hours. The characteristic diagram on the lower side of FIG. 12 shows spectral intensities before the test, and the characteristic diagram on the upper side of FIG. 12 shows spectral intensities after the test. From FIG. 12, the corrosion of the antenna pattern may be defined by quantifying the corrosion of the antenna pattern by means other than visual observation. Accordingly, in the case of FIG. 12, with $Na_2OH$ taken as an example, the intensity (substantially 1.5 times) of $Na_2OH$ after the test is 3 times or less the intensity (substantially 0.5) of $Na_2OH$ before the test; accordingly, the corrosion is judged as having been inhibited.

As detailed above, according to the invention, owing to presence of an amorphous Ni layer, pinhole formation is inhibited and thereby corrosion of the antenna pattern may be avoided.

What is claimed is:

1. A portable terminal comprising:

a non-conductive resin chassis that is formed by molding a molding material and internally provided with a printed circuit board on which a wireless circuit is formed; and an antenna pattern that is disposed on a wall surface of the chassis and in a region excluding an eject pin track formed when the chassis electrically connected with the printed circuit board is formed, wherein the antenna pattern is constituted by sequentially laminating a copper layer, a nickel layer and a gold layer by electroless plating, and the nickel layer is rendered amorphous.

2. The portable terminal according to claim 1, wherein the Vickers hardness of a surface of the antenna pattern is 500 HV to 550 HV.

3. The portable terminal according to claim 1, wherein the antenna pattern is constituted of two open ends and an intermediate portion between the open ends, the line width of the thinnest portion of the antenna pattern is 0.3 mm or more, and the average thickness of plating of the two open ends and intermediate portion is 10 μm or more for the copper layer, 6 μm or more for the nickel layer and 0.03 μm or more for the gold layer.

4. The portable terminal according to claim 1, wherein the antenna pattern is constituted of two open ends and an intermediate portion between the open ends, and the product WT of the line width W of the thinnest portion of the antenna pattern and the thickness T of an average copper layer of the two open ends and intermediate portion is $3\times10^{-9}$ $m^2$ or more.

5. The portable terminal according to claim 1, wherein the antenna pattern is constituted of two open ends and an intermediate portion between the open ends, and, when the line width of the thinnest portion of the antenna pattern is represented by W, the thickness of an average copper layer of the two open ends and intermediate portion is represented by T, the resistance of the average copper layer is represented by R, the line length of the antenna pattern is represented by L and the conductivity of the copper layer is represented by σ, $\sigma=L/R\cdot W\cdot T$ is satisfied.

6. The portable terminal according to claim 1, wherein the internal stress of the antenna pattern is within ±10 MPa.

7. The portable terminal according to claim 1, wherein the rate of elongation of the antenna pattern is 1 to 5%.

8. The portable terminal according to claim 1, wherein after a salt water resistance test for 96 hours, carbonate or sulfate is 3 times or less that before the test in an ion spectrum by time-of-flight secondary ion mass spectrometry.

9. The portable terminal according to any one of claims 1 to 8, wherein the dissolution temperature of the nonconductive resin is 65° C. or more.

10. A built-in antenna comprising:

a molded body for forming a nonconductive resin chassis that is formed by molding a molding material and internally provided with a printed circuit board on which a wireless circuit is formed; and an antenna pattern that is disposed on a wall surface of the molded body and in a region excluding an eject pin track formed when the chassis electrically connected with the printed circuit board is formed, wherein the antenna pattern is constituted by sequentially laminating a copper layer, a nickel layer and a gold layer by electroless plating, and the nickel layer is rendered amorphous.

11. The built-in antenna according to claim 10, wherein the Vickers hardness of the Ni layer of the antenna pattern is 500 HV to 550 HV.

12. The built-in antenna according to claim 10, wherein the antenna pattern is constituted of two open ends and an intermediate portion between the open ends, the line width of the thinnest portion of the antenna pattern is 0.3 mm or more, and the average thickness of plating of the two open ends and intermediate portion is 10 μm or more for the copper layer, 6 μm or more for the nickel layer and 0.03 μm or more for the gold layer.

13. The built-in antenna according to claim 10, wherein the antenna pattern is constituted of two open ends and an intermediate portion between the open ends, and the product WT of the line width W of the thinnest portion of the antenna pattern and the thickness T of an average copper layer of the two open ends and intermediate portion is $3\times10^{-9}$ $m^2$ or more.

14. The built-in antenna according to claim 10, wherein the antenna pattern is constituted of two open ends and an intermediate portion between the open ends, and, when the line width of the thinnest portion of the antenna pattern is represented by W, the thickness of an average copper layer of the two open ends and intermediate portion is represented by T, the resistance of the average copper layer is represented by R, the line length of the antenna pattern is represented by L and the conductivity of the copper layer is represented by σ, $\sigma=L/R\cdot W\cdot T$ is satisfied.

15. The built-in antenna according to claim 10, wherein the internal stress of the antenna pattern is within ±10 MPa.

16. The built-in antenna according to claim 10, wherein the rate of elongation of the antenna pattern is 1 to 5%.

17. The built-in antenna according to claim 10, wherein after a salt water resistance test for 96 hours, carbonate or sulfate is 3 times or less that before the test in an ion spectrum by time-of-flight secondary ion mass spectrometry.

18. The built-in antenna according to any one of claims 10 to 17, wherein the dissolution temperature of the nonconductive resin is 65° C. or more.

* * * * *